US009744777B2

(12) United States Patent
Brown et al.

(10) Patent No.: US 9,744,777 B2
(45) Date of Patent: Aug. 29, 2017

(54) METHODS TO PACKAGE AND TRANSMIT ENERGY OF HIGH INTENSITY LED DEVICES

(71) Applicant: AIR MOTION SYSTEMS, INC., River Falls, WI (US)

(72) Inventors: Michael H Brown, River Falls, WI (US); Robert L Sargent, Chelmsford, MA (US)

(73) Assignee: Air Motion Systems, Inc., River Falls, WI (US)

( * ) Notice: Subject to any disclaimer, the term of this patent is extended or adjusted under 35 U.S.C. 154(b) by 608 days.

(21) Appl. No.: 14/013,257

(22) Filed: Aug. 29, 2013

(65) Prior Publication Data

US 2015/0014895 A1 Jan. 15, 2015

Related U.S. Application Data

(63) Continuation-in-part of application No. 13/940,088, filed on Jul. 11, 2013, now abandoned.

(51) Int. Cl.
*B41J 11/00* (2006.01)
*B41M 7/00* (2006.01)

(52) U.S. Cl.
CPC ..... *B41J 11/002* (2013.01); *B41M 7/0081* (2013.01)

(58) Field of Classification Search
CPC ..... B41J 11/002
See application file for complete search history.

(56) References Cited

U.S. PATENT DOCUMENTS

2009/0040754 A1* 2/2009 Brukilacchio ..... A61B 1/0653 362/228

FOREIGN PATENT DOCUMENTS

WO WO 02/093265 * 11/2002

* cited by examiner

*Primary Examiner* — Larry Thrower
(74) *Attorney, Agent, or Firm* — Skaar Ulbrich Macari, P.A.

(57) ABSTRACT

The curing assembly of this invention has one or more fiber optic cables, each transmitting light to a head, which distributes the light onto a substrate in a desired geometric pattern and intensity. Little or none of the heat generated by a light source is transmitted to the vicinity of the substrate. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims. 37 C.F.R. §1.72(b).

13 Claims, 13 Drawing Sheets

METHODS TO PACKAGE AND TRANSMIT ENERGY OF HIGH INTENSITY LED DEVICES

CROSS-REFERENCE TO RELATED APPLICATIONS

This is a continuation-in-part of U.S. patent application Ser. No. 13/940,088, filed 11 Jun. 2013, which, in turn, claims priority under 35 U.S.C. §119 (e) to U.S. Provisional Application No. 61/670,144, filed 11 Jul. 2012, each of the foregoing patent applications hereby incorporated by reference.

BACKGROUND OF THE INVENTION

1. Field of the Invention

This invention relates to curing assemblies and, in particular, this invention relates to assemblies curing UV-curable ink or coating on a substrate.

2. Background

High intensity LED devices present great challenges in designing thermal and optical energy and optical energy management. One particular problem when designing LED light-emitting systems is that one must focus high levels of narrow or spot-focused energy in limited or small spaces, at heat-sensitive locations, or in otherwise hazardous locations. These applications may require a physically compact, low heat-emitting, focused (non-scattered) and electrically or intrinsically safe light source device at the working location. One typical application where these problems exist is, but is not limited to, curing UV (Ultraviolet) curing ink in an ink jet printing device, more specifically, the "pinning" or pre-curing (gelling) of dispensed UV ink jet printing ink. Following the dispensing of ink jet ink onto a substrate a "pinning" function is often employed. Ink jet heads must be grouped closely together when multiple colors are used to produce sharp clear images, whereas if not, the ink has a tendency to "sag" or blend together, thereby obscuring the crispness or sharpness of the image being printed. Because ink jet printing "heads" or nozzles must be grouped tightly together when multiple ink colors are dispensed, this gives rise to the need to employ the device disclosed herein. Further, the non-focused or randomly scattered light energy typically present in UV LED devices utilized for this purpose causes the UV ink to cure or gel on the heads or nozzles, thus impairing function, the impaired function resulting in reduced quality of printed media and an increase in maintenance time to clean the heads.

Additionally when pinning ink printed on substrates, the present known curing devices require the ink jets to be separated so as to allow these curing devices to deliver sufficient radiation to the ink on the printed substrate. This separation often results in a printed substrate having less than optimal clarity.

There is then a need for a curing device which cures ink with a radiation pattern which is flexible in shape and intensity, but which transmits little or no heat to the substrate being radiated and which minimizes the distance between ink jets.

SUMMARY OF THE INVENTION

This invention substantially meets the aforementioned needs of the industry by providing:

A device that utilizes, but is not limited to utilizing individually or in combination, fiber optic transmission bundles of glass or polymer, optical lenses or lens assemblies of glass or polymer, solid fiber (large scale) or similar light transmission methods.

A device, in one embodiment, that transmits the light from a square or rectangular LED light source to a narrow and compact emitting head or lamp.

A device that requires no cooling of thermal energy at the emitting head or lamp unit.

A device that can be fabricated in many shapes allowing it to be positioned between the ink jet print heads in a typical multi-color ink jet printing system.

A device that be rendered intrinsically safe, thus allowing it to operate in hazardous locations.

A device that can be custom tailored physically to integrate in, but not be limited to, many commercially produced printing, coating, dispensing and dosing machines.

A device that can be fabricated to operate in many optical energy emitting configurations.

A device that can be positioned within, but not be limited to a distance of 10 mm or less from the media or curing surface.

A device that emits zero or near zero excess thermal energy at the emitter or lamp unit.

Accordingly, there is provided a curing assembly having a singular lens or a plurality of lenses (optionally including a lens assembly), a fiber optic cable and a pinning head. The fiber optic cable has a plurality of optic fibers receiving light which has passed through the lens. The head positions the optic fibers so that light emitted from the optic fibers impinges a substrate in a geometric pattern. The geometric pattern may be remote from any light generator, which may also generate heat. The head may be fixed in a position relative to the substrate. The optic fibers may be fixed within the head as the head is manufactured. In some embodiments, a plurality of either or both of light generators or pinning heads (for example, bifurcated or trifurcated) will be present, in which case differing wave spectra with differing peak wave lengths can be generated and blended.

In some embodiments, light leaves a light source, passes through a lens or lens assembly for collimation, passes through another lens or lens assembly for focusing on the fiber bundle cable, which then transmits the light to the substrate. While light emitted directly from optic fiber ends may directly impinge the substrate, light emitted from optic fiber ends may pass through an optic, such as a rod optic or another optic with a hemispherical or aspherical profile to further focus the light before the light impinges the substrate.

These and other objects, features, and advantages of this invention will become apparent from the description which follows, when considered in view of the accompanying drawings.

It is understood that the above-described figures are only illustrative of the present invention and are not contemplated to limit the scope thereof.

DETAILED DESCRIPTION

Each of the additional features and methods disclosed herein may be utilized separately or in conjunction with other features and methods to provide improved devices of this invention and methods for making and using the same. Representative examples of the teachings of the present invention, which examples utilize many of these additional features and methods in conjunction, will now be described in detail with reference to the drawings. This detailed description is merely intended to teach a person of skill in the art further details for practicing preferred aspects of the present teachings and is not intended to limit the scope of the invention. Therefore, combinations of features and methods disclosed in the following detailed description may not be necessary to practice the invention in the broadest sense and are instead taught merely to particularly describe representative embodiments of the invention.

A person of ordinary skill in the art will readily appreciate that individual components shown on various embodiments of the present invention are interchangeable to some extent and may be added or interchanged on other embodiments without departing from the spirit and scope of this invention.

Figure 12E:
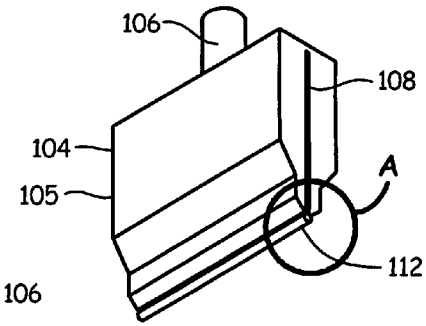
FIG. 12*e* is a perspective view of the pinning head of FIG. 12*a*.
Figure 12F:
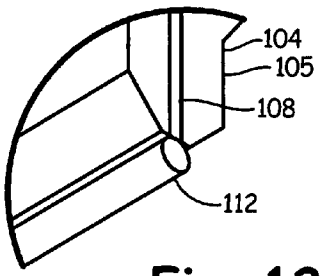
FIG. 12*f* is a partial view of the pinning head of FIG. 12*a* as identified in FIG. 12*e*.
Figure 12D:
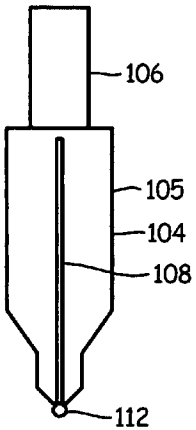
FIG. 12*d* is a side view of the pinning head of FIG. 12*a*.
Figure 12A:
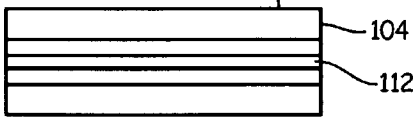
FIG. 12*a* is a bottom view of an embodiment of a pinning head of this invention.
Figure 12B:
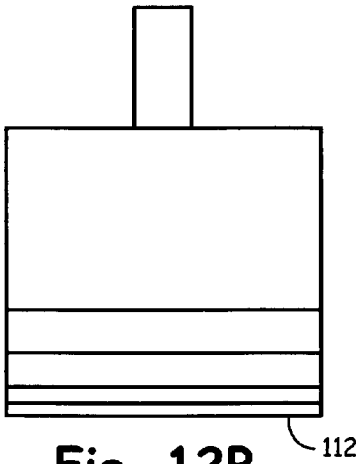
FIG. 12*b* is a front view of the pinning head of FIG. 12*a*.
Figure 12C:
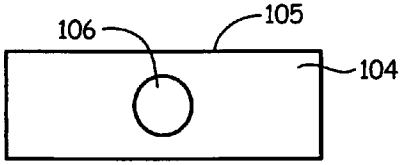
FIG. 12*c* is a top view of the pinning head of FIG. 12*a*.
Figure 13A:
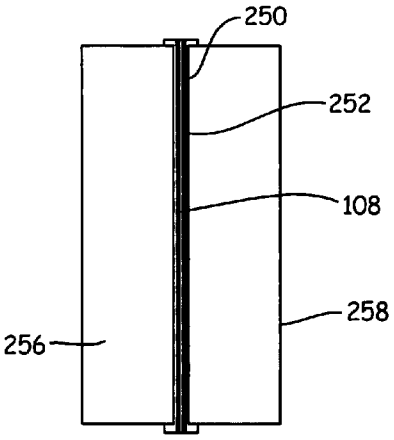
FIG. 13*a* is a bottom view of another embodiment of a pinning head of this invention deployed between two printing heads.
Figure 13B:
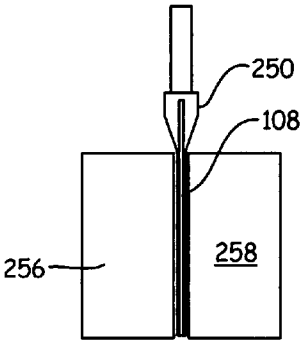
FIG. 13*b* is a side view of the pinning head of FIG. 13*a*.
Figure 13C:
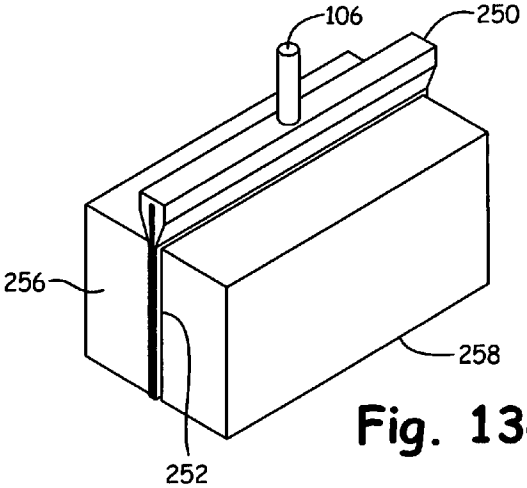
FIG. 13*c* is a perspective view of the pinning head of FIG. 13*a*.
Figure 13D:
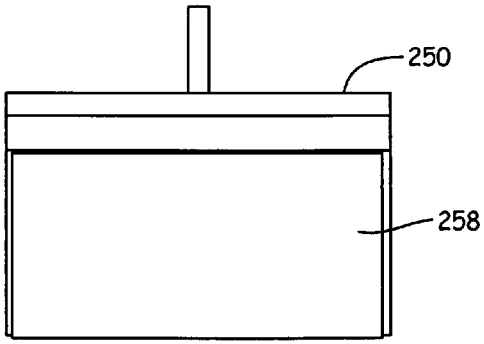
FIG. 13*d* is a front view of the pinning head of FIG. 13*a*.

FIGS. 1*a*-1*f*, 2*a*-2*e* show one embodiment of a head assembly 100 of this invention, the head assembly 100 having a pinning head 104 with a pinning head body 105 and a fiber optic cable 106. Present in each fiber optic cable 106 is a plurality of optic fibers 108 to convey radiation such as ultraviolet (UV) light from a light source to a substrate such as a page being printed and on which has been deposited a UV-curing ink during printing. The heads 104 may be formed by injection molding or by first inserting material into a mold into which the optic cables 106 and fibers 108 are positioned previously. The material is then allowed to solidify or to cure to thereby secure the optic cables 106 and fibers 108 in position. As can be seen, the light is transmitted to the head assembly by the fiber optic cable 106 which is round or elliptical in cross section. However, once in the head assembly 100, the light is transmitted to be emitted from ends 110 of the optic fibers into a focused beam having a desired geometrical shape, such as the linear shape shown in FIGS. 1*a*-1*f*, 2*a*-*e*. Light emitted from the embodiments in FIGS. 1*a*-1*f*, 2*a*-2*e* would impinge a substrate in a linear pattern with a substantially equal or uniform level of illumination throughout the pattern, for example from a distance between about 1 mm and 10 mm. Optionally, a rod optic 112, such as shown in FIGS. 12*d*-12*f*, may be present between the optic fiber ends 110 and the substrate on which is a deposited substance to be cured.

While not shown, a ball lens or a collimating lens may be present over the terminal fiber optic configuration to further provide the desired pattern, intensity, and uniformity of illumination. Additionally, a ball lens, e.g., 20 mm (+/−1%, 5%, 10%), or collimating lens may be present proximate (such as downstream from) the light source to focus or collimate the light entering the fiber optic cable 106. A person of ordinary skill in the art will realize that the desired geometric shape for the emitted focused light may include rectangular and square shapes, as well as round and oval, the configuration of these shapes being determined by factors such as the amount of light needed, the type of ink being cured, and the amount of time or speed necessary to cure the ink being deposited on the substrate.

Figure 1A:
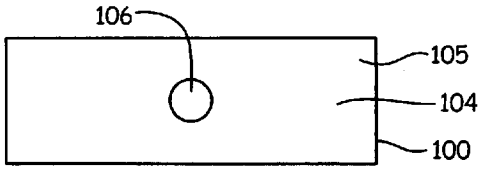
FIG. 1*a* is a top view of one embodiment of a pinning head of this invention for transmitting radiation to a substrate.
Figure 1B:
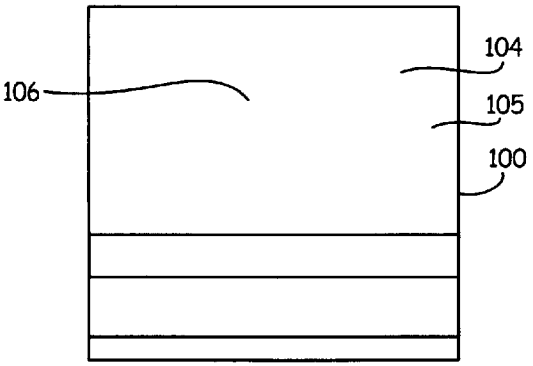
FIG. 1*b* is a side view of the pinning head of FIG. 1*a*.
Figure 1C:
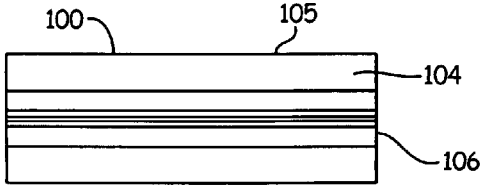
FIG. 1*c* is a bottom view of the pinning head of FIG. 1*a*.
Figure 1D:
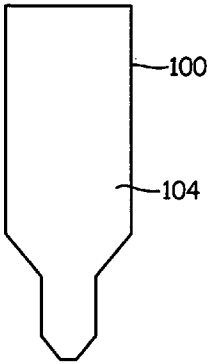
FIG. 1*d* is an end view of the pinning head of FIG. 1*a*.
Figure 1E:
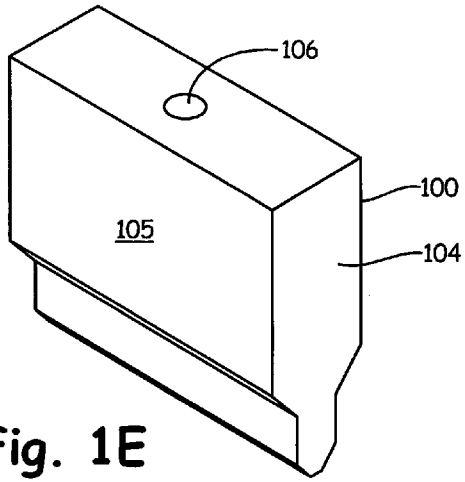
FIG. 1*e* is a perspective view of the pinning head of FIG. 1*a*.
Figure 1F:
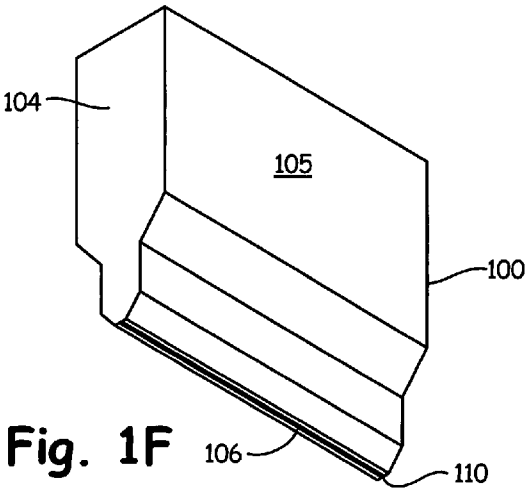
FIG. 1*f* is another perspective view of the pinning head of FIG. 1*a*.
Figure 2A:
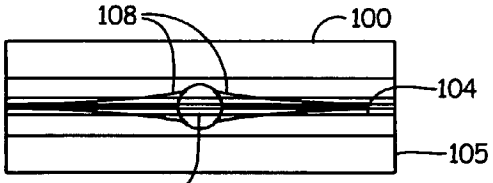
FIG. 2*a* is a top view of the pinning head of FIG. 1*a* showing optical fibers present therein.
Figure 2B:
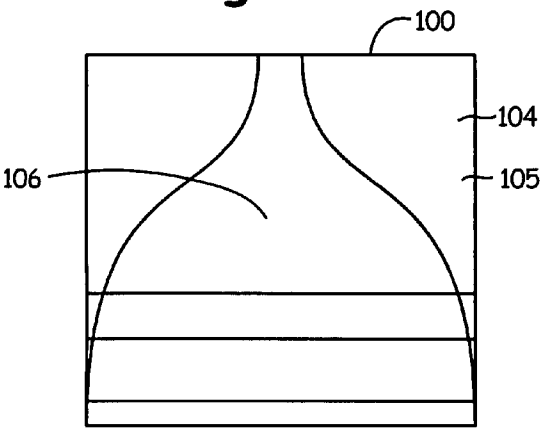
FIG. 2*b* is a side view of the pinning head of FIG. 1*a* showing the optical fibers present therein.
Figure 2C:
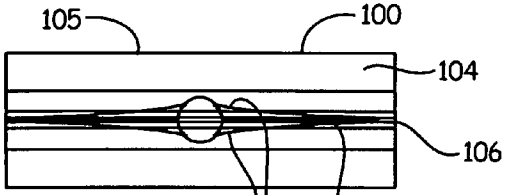
FIG. 2*c* is a bottom view of the pinning head of FIG. 1*a* showing the optical fibers present therein.
Figure 2D:
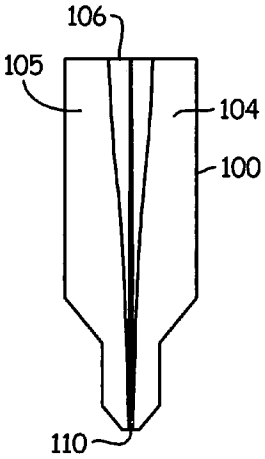
FIG. 2*d* is an end view of the pinning head of FIG. 1*a* showing the optical fibers present therein.
Figure 2E:
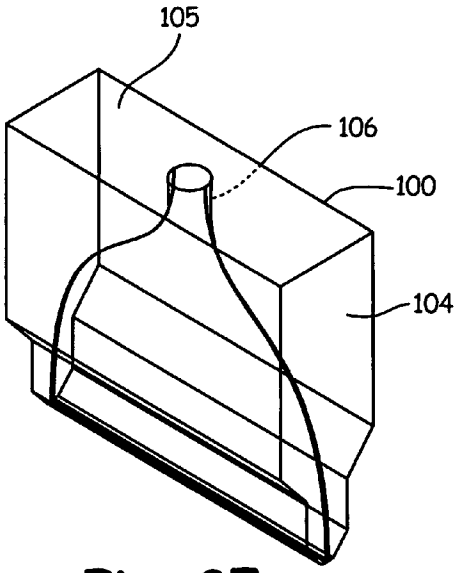
FIG. 2*e* is a perspective view of the pinning head of FIG. 1*a* showing the optical fibers present therein.
Figure 3D:
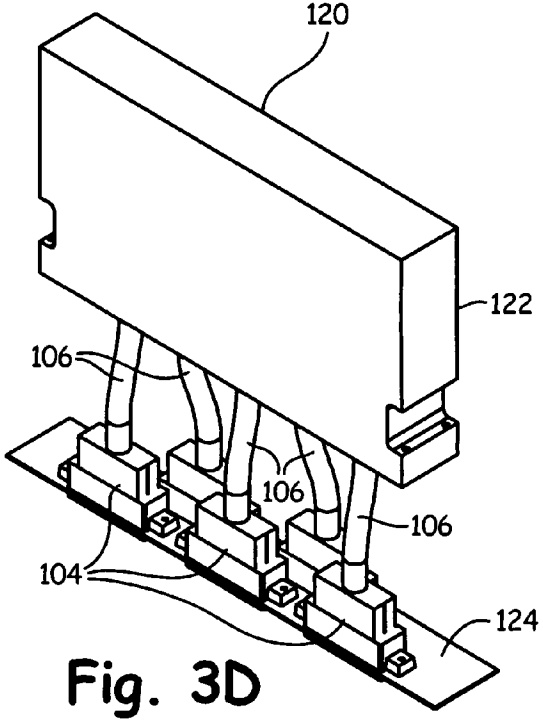
FIG. 3*d* is a perspective view of the curing apparatus of FIG. 3*a*.
Figure 3C:
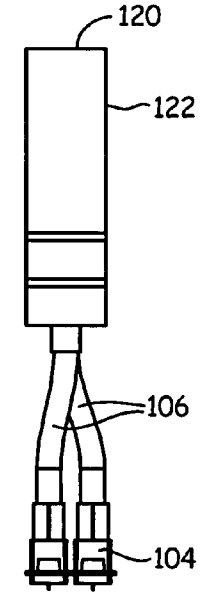
FIG. 3*c* is an end view of the curing apparatus of FIG. 3*a*.
Figure 3A:
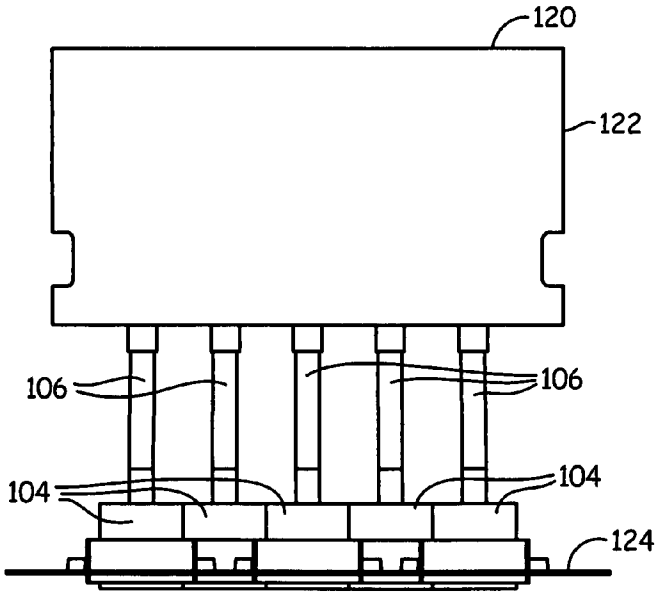
FIG. 3*a* is a side view of one embodiment of a fiber optic-transmitted curing apparatus of this invention.
Figure 3B:
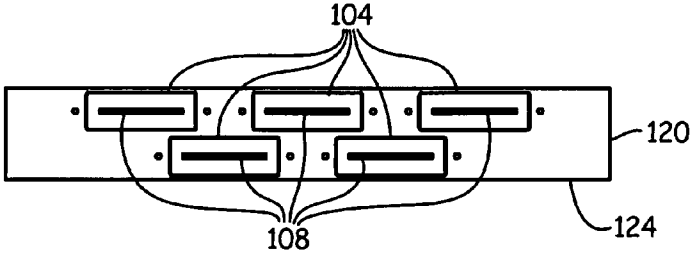
FIG. 3*b* is a bottom view of the curing apparatus of FIG. 3*a*.

Referring to FIGS. 3*a*-3*d*, one embodiment of a curing assembly 120 is shown to include a light source 122, a plurality of fiber optic cables 106 and a plurality of pinning heads 104. The heads are mounted to, and held in position by, one or more plates 124. Each optic cable 106 contains a plurality of optic fibers 108 (not shown), which transmit radiation from the light source, through one of the heads 104, where the radiation is emitted from the optic fiber ends 110 (such as shown in FIG. 2*c*) to impinge on a substrate. For example, UV light is generated by a light source, e.g., including UV-emitting LEDs. Within the light source may also be a cooling apparatus (not shown) to remove heat generated by the LEDs when operating to emit UV light. As stated above, a lens may be positioned to focus or collimate UV light emitted from the LEDs before the light enters the fiber optic cables. The focused or collimated UV light is then transmitted from the light source to the heads, where the generally linearly configured fibers at the terminal end of each head direct UV light emitted into a generally linear pattern providing generally equal illumination throughout the pattern, optionally by further means of a lens positioned at the terminal end of each head (not shown). The multiple heads are held in a desired configuration (e.g., offset) by being attached to a plate. The plate, in turn, can be attached to a printing press at a desired location, position, and distance from the ink jet head(s) and substrate. The fiber optic cable may be about 1 m in length; however, lengths considerable longer or shorter are contemplated and would be determined by the materials used in the fiber optic cable, types of lens present, desired relative positions of the printing press apparatus, types of ink to be cured, and substrate to be printed upon.

Figure 4:
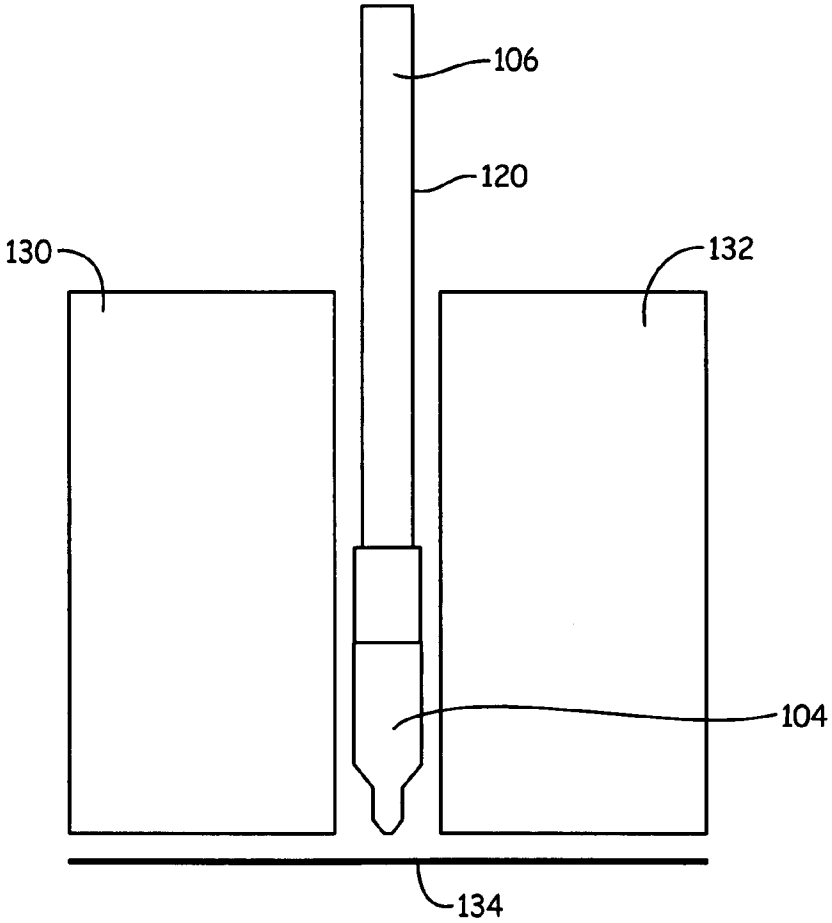
FIG. 4 is an end view of one embodiment of the curing apparatus of this invention disposed between ink jet heads.

FIG. 4 shows an exemplary curing assembly 120 being used between ink jet heads 130, 132. The ink jet heads 130, 132 are in close proximity and are depositing UV-curable ink on a substrate 134. The deposited ink is then cured by UV light emitted from head 104 after the light has been generated by a light source (not shown), focused or collimated, then transmitted to the head 104 through optic fibers within optic cable 106. A plate or other device fixing the head 104 in a desired position is not shown, but may be present.

Figure 5B:
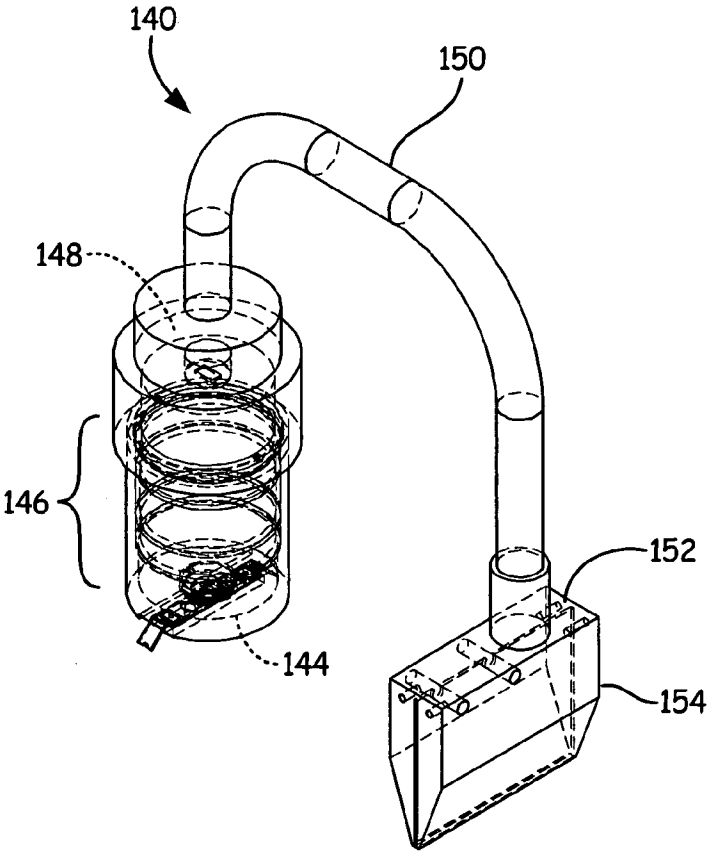
FIG. 5*b* is a perspective view of the curing apparatus of FIG. 5*a*.
Figure 5A:
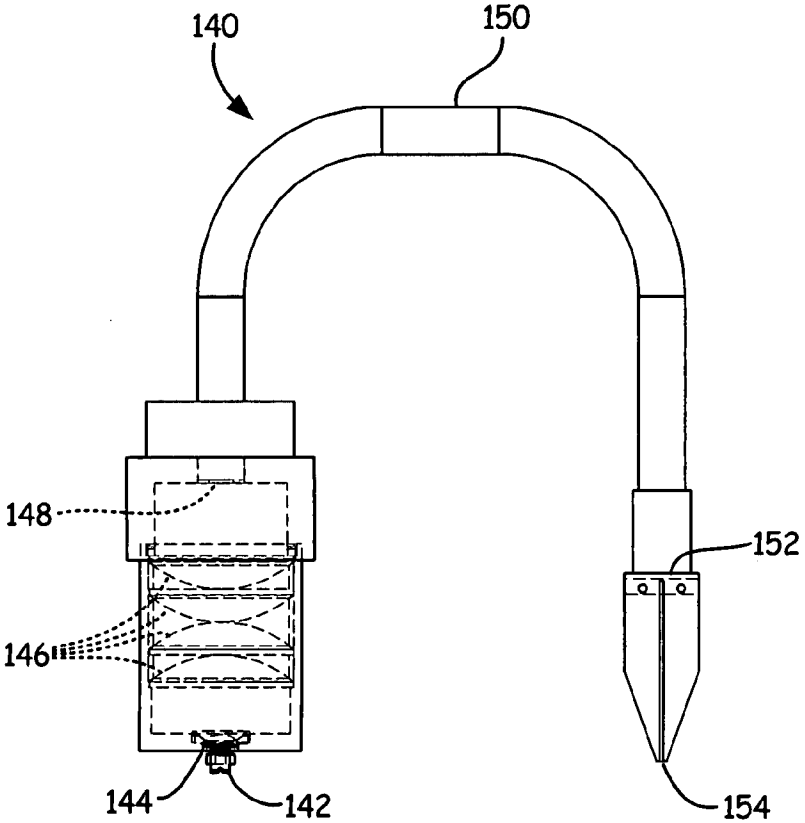
FIG. 5*a* is a frontal view of another embodiment of the curing apparatus of this invention.
Figure 6A:
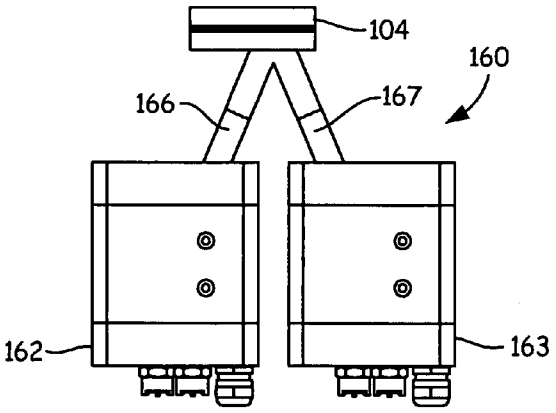
FIG. 6*a* is a bottom view of another embodiment of a fiber optic-transmitted curing apparatus of this invention.
Figure 6C:
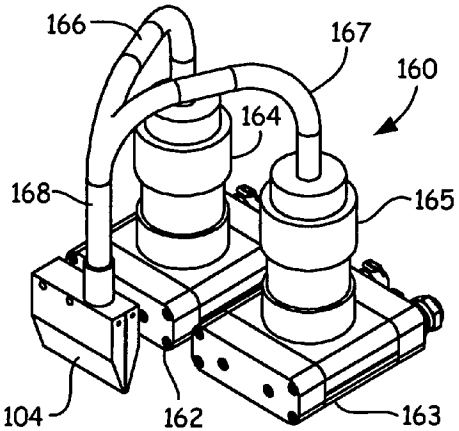
FIG. 6*c* is a perspective view of the curing apparatus of FIG. 6*a*.
Figure 6B:
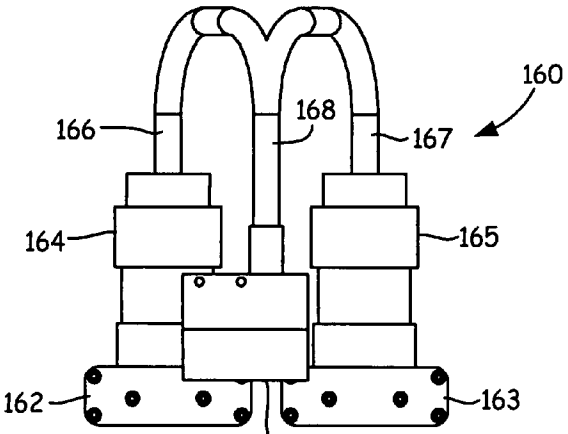
FIG. 6*b* is a front view of the curing apparatus of FIG. 6*a*.
Figure 6D:
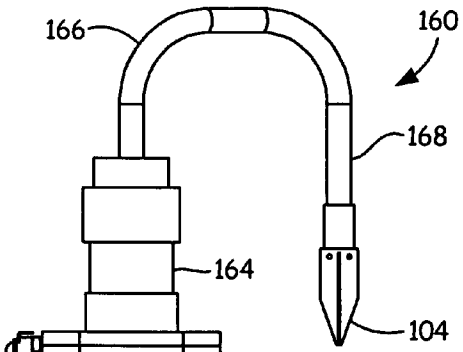
FIG. 6*d* is a side view of the curing apparatus of FIG. 6*a*.
Figure 7C:
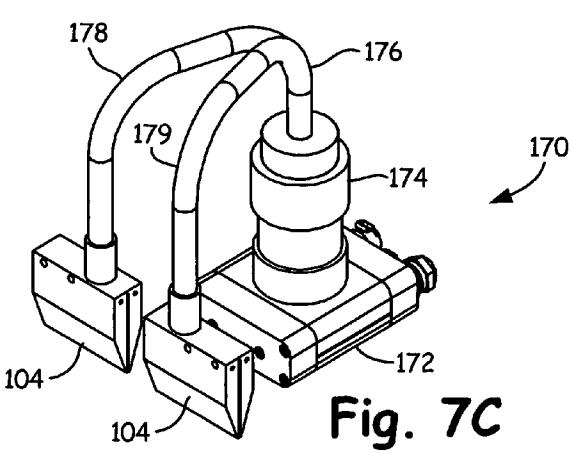
FIG. 7*c* is a perspective view of the curing apparatus of FIG. 7*a*.
Figure 7D:
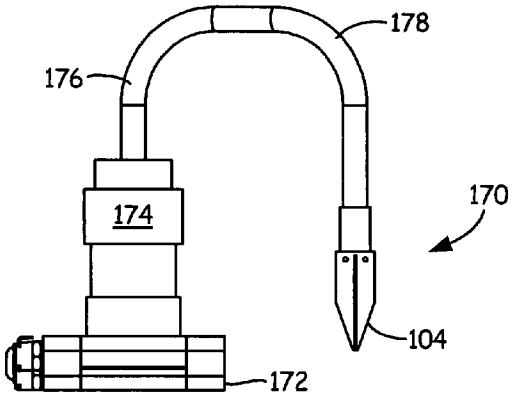
FIG. 7*d* is a side view of the curing apparatus of FIG. 7*a*.
Figure 7A:
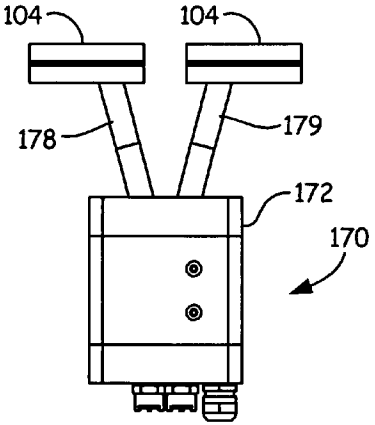
FIG. 7*a* is a bottom view of yet another embodiment of a fiber optic-transmitted curing apparatus of this invention.
Figure 7B:
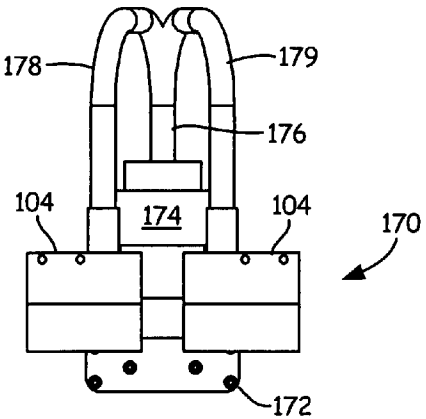
FIG. 7*b* is a front view of the curing apparatus of FIG. 7*a*.
Figure 8A:
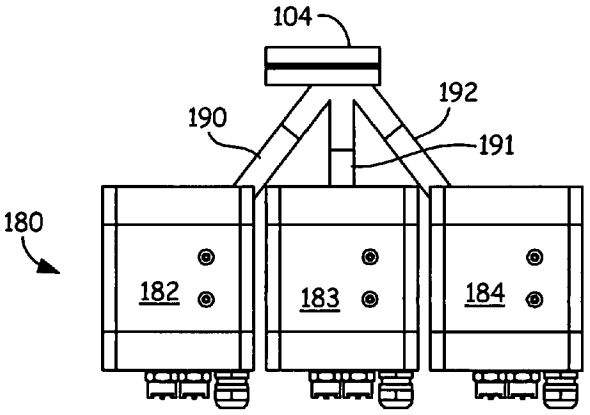
FIG. 8*a* is a bottom view of still yet another embodiment of a fiber optic-transmitted curing apparatus of this invention.
Figure 8B:
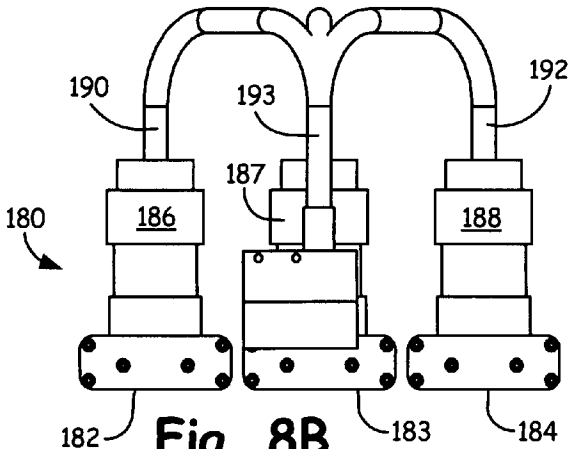
FIG. 8*b* is a front view of the curing apparatus of FIG. 8*a*.
Figure 8C:
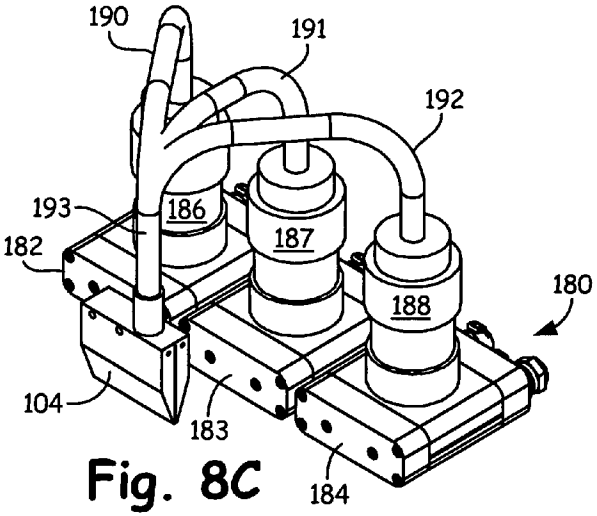
FIG. 8*c* is a perspective view of the curing apparatus of FIG. 8*a*.
Figure 8D:
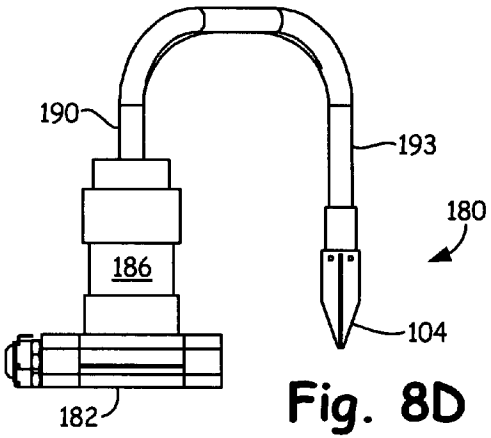
FIG. 8*d* is a side view of the curing apparatus of FIG. 8*a*.
Figure 9A:
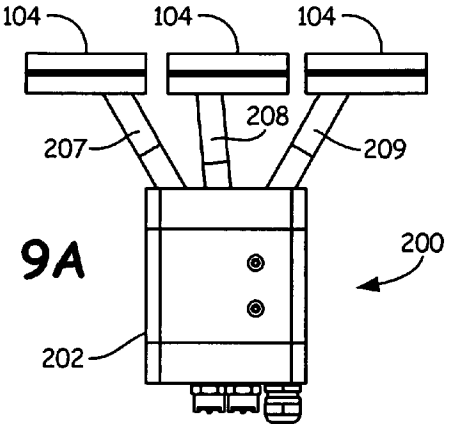
FIG. 9*a* is a bottom view of yet another embodiment of a fiber optic-transmitted curing apparatus of this invention.
Figure 9C:
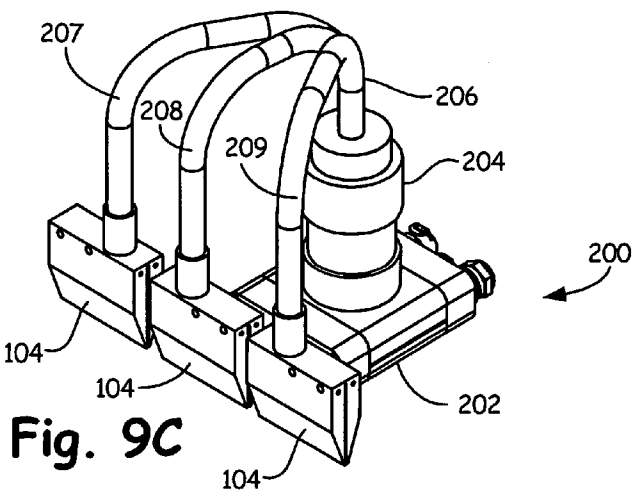
FIG. 9*c* is a perspective view of the curing apparatus of FIG. 9*a*.
Figure 9B:
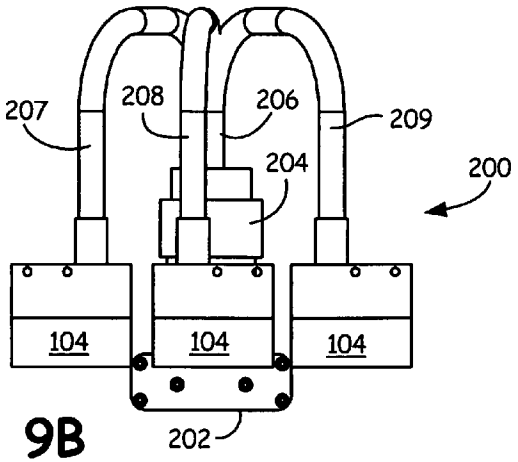
FIG. 9*b* is a front view of the curing apparatus of FIG. 9*a*.
Figure 9D:
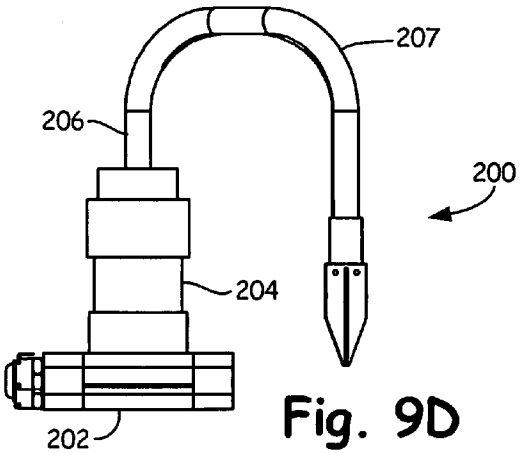
FIG. 9*d* is a side view of the curing apparatus of FIG. 9*a*.

Another example of a curing assembly of this invention is shown in FIGS. 5*a*, 5*b* at 140. In this example, light generated from a light source (not shown) impinges the surface 142 of a collimating lens 144, then is focused in a lens assembly 146. An aspherical lens maybe present in addition to the foregoing lens(es), 144, 146. Accordingly, the lens 144 may be an aspherical lens rather than a collimating lens. The focused light then enters a proximal end 148 of a fiber bundle 150 (or 106) and exits at a distal end 152 to be distributed in a desired geometric pattern by the pinning head 154 (or 104). A plate or other device fixing the head 154 or 104 in a desired position is not shown, but may be present.

FIGS. 6*a*-6*d* show still another embodiment of the curing assembly of this invention at 160, the curing assembly 160 including light sources 162, 163, lens assemblies 164, 165, and fiber optic cables 166, 167 which transmit light to fiber optic cable 168. Light is then transmitted through fiber optic cable 168 to a pinning heat 104. In this embodiment, optic fibers from the fiber optic cables 166, 167 extend continuously through fiber optic cable 168 and terminate in pinning head 104 as shown and described above. Differing peak wavelengths of UV light could be emitted from the light sources 162, 163.

FIGS. 7*a*-7*d* depict yet another embodiment of the curing assembly of this invention at 170. The curing assembly 170 has a light source 172, a lens assembly 174, fiber optic cables 176, 178, 179, and two pinning heads 104.

Separate optic fibers from fiber optic cable 176 extend into one of fiber optic cables 178, 179 and terminate in one of heads 104 as described above.

FIGS. 8*a*-8*d* show still yet another embodiment of the curing assembly of this invention at 180 and include light sources 182, 183, 184, lens assemblies 186, 187, 188, fiber optic cables 190, 191, 192, 193, and a pinning head 104. Individual optic fibers from each of the fiber optic cables 190, 191, 192 extend through fiber optic cable 193 and terminate in pinning head 104 as described above.

FIGS. 9*a*-9*d* depict still another embodiment of the curing assembly of this invention at 200, which has a light source 202, lens assembly 204, fiber optic cables 206, 207, 208, 209, and three pinning heads 104. In this embodiment, individual optic fibers from fiber optic cable 206 extend through one of fiber optic cables 207, 208, 209, and terminate in one of the three heads 104.

Figure 10A:
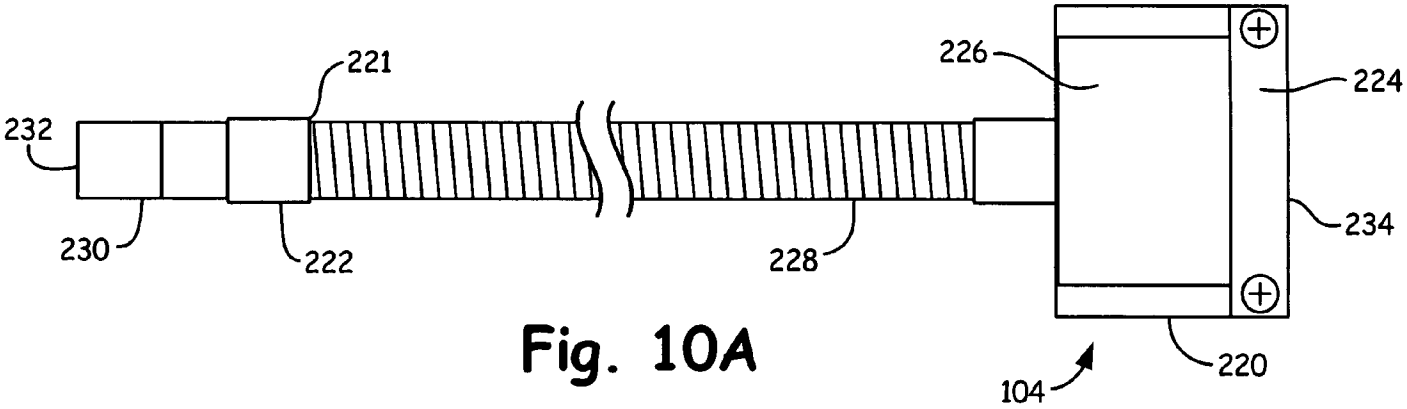
FIG. 10*a* is a plan view of an exemplary pinning head of this invention.
Figure 10C:
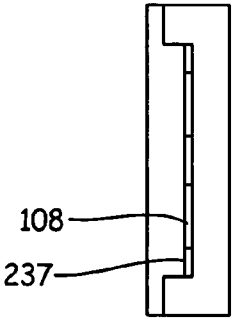
FIG. 10*c* is an end view of the pinning head of FIG. 10*a*, viewed from distal end 234.
Figure 10B:
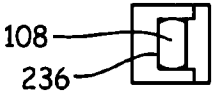
FIG. 10*b* is an end view of the pinning head of FIG. 10*a*, viewed from proximal end 232.

Referring to FIGS. 10*a*-10*c*, the pinning head 104 has a block base 220. The fiber optic cable 221 encases a plurality of optic fibers 108 in a bundle indicated at 236, the fiber optic cable enclosed by a sheathing 228. The proximal end 232 of the fiber optic cable 221 is indicated by end tip 230, a collar 222 present distal from the end top 230. The pinning head 104 has a cover 226 and terminates in a distal end 234. The pinning head 104 positions and secures optic fibers 108 in a linear bundle configuration 237 is the embodiment shown. In FIGS. 10*a*-10*c* all dimensions are shown in inches and all dimensions will vary by about 1%, about 5%, or about 10% from values depicted. The width dimension 238 may be about 0.54 inch or less than about 15 mm, such width dimension varying by about 1%, about 5%, or about 10%.

The embodiments with a plurality of light sources can provide a plurality of light spectra with differing peak wave lengths for curing a blend of inks with differing wave length requirements. Multiple light sources can also be combined to provide a greater intensity of light or the same intensity of light on a longer print head. A single light source (e.g., LED) can be used to illuminate two or more heads with corresponding reduced intensity, but effecting a longer cure length or enabling multiple curing positions. Accordingly, the curing assembly of this invention includes one or a plurality of both light sources and pinning heads. While not depicted, curing assemblies with pluralities of both light sources and pinning heads are contemplated to be included in this invention.

In certain embodiments, the pinning heads of this invention have no electronics. There is accordingly, no necessity to cool these pinning heads. Thus, these pinning heads have no cooling apparatus. Cooling apparatus may be present within or proximate the light source. However, the light source is remote from the instant pinning head(s). Because there are no electronics to cool in the pinning head and because the light source is remote, there is no air turbulence generated by the pinning heads of this invention. Therefore, ink patterns being deposited by ink jet heads 130, 132 (see FIG. 4) are not affected by air turbulence from the pinning head 104 because the pinning head 104 generates no air turbulence at all.

Figure 11C:
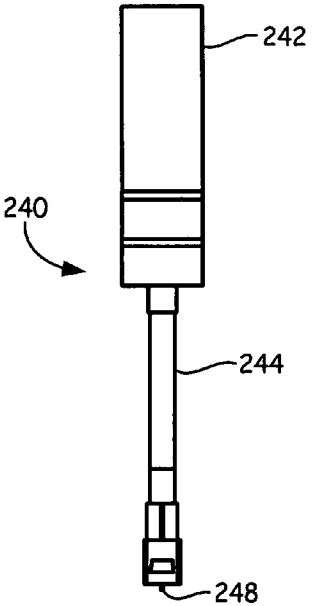
FIG. 11*c* is a side view of the curing apparatus of FIG. 11*a*.
Figure 11A:
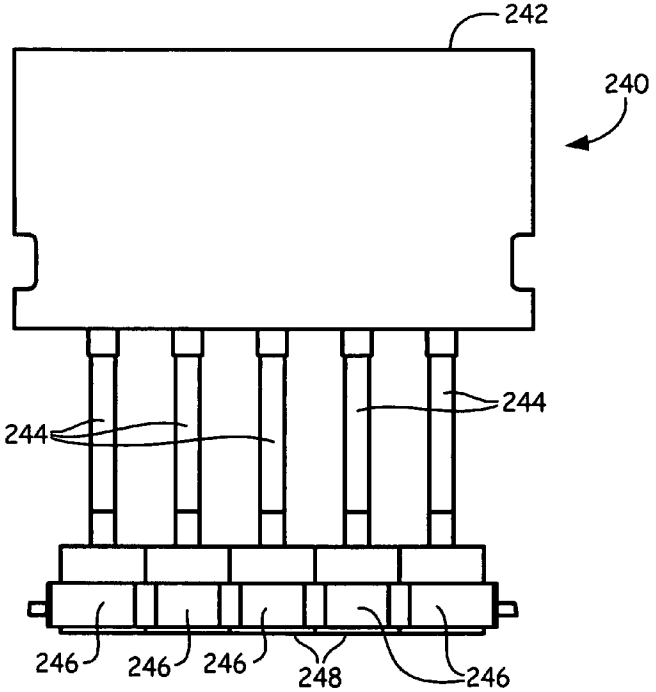
FIG. 11*a* is a front view of another embodiment of the curing apparatus of this invention.
Figure 11B:
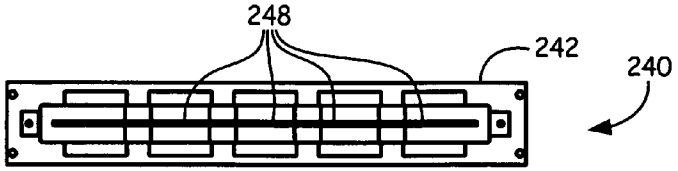
FIG. 11*b* is a bottom view of the curing apparatus of FIG. 11*a*.

A curing assembly 240 shown in FIGS. 11*a*-11*c* has one or more light sources 242 producing light (e.g., UV), which is being transmitted by optic fibers within optic cables 244 to pinning heads 246. Because of the economies achieved by the lack of cooling structure, the dimensions of the pinning heads can be greatly reduced to enable a continuously linear pattern of optic fibers 248. This continuous linear pattern of optic fibers 248 provides a more uniform illumination of the substrate being printed. Indeed, the continuous linear pattern of optic fibers 248 is uninterrupted and remains continuous over the entire length of the plurality of pinning heads 246 present in the embodiment shown.

FIGS. 12*a*-12*f* show a pinning head 104 of this invention, in which the optic fibers 108 emit, e.g., UV light. The emitted light is then focused or refracted by a rod optic 112 before being directed at a substrate for curing.

FIGS. 13*a*-13*d* depict a pinning head 250, which has a pinning head body 252 and a plurality of optic fibers 108 positioned by the pinning head body 252. The optic fibers, before being present in the pinning head body 252 are bundled in a fiber optic cable 106. Due in part to the lack of cooling apparatus, the distal end 254 of the pinning head body 252 can be extremely small in cross sectional dimension. For example, the exemplary distal end 254 depicted has a depth of 0.197 (+/−1%, 5%, 10%) inch and the optical fibers may be 0.118 (+/−1%, 5%, 10%) inch in depth. The pinning head 250 is shown deployed between two printing heads 256,258, which may be about 2.402 inches in height and 4.921 inches in length. However, any dimension for the printing heads may be utilized to achieve the desired pattern of ink of a substrate being printed.

In the context of this invention and as enabled herein, one typical ink-curing application occurs within an ink printing device. In the ink printing device, ink is dispensed by multiple ink-dispensing units, which are applying various colors or treatments to the substrate. The precision of application and quality of this process is greatly affected by the distance between the dispensing units. As the distance between dispensing units decreases, the better the quality of printing will be enhanced.

Thus, the device of this invention greatly reduces the distance between the printing units and improves the overall process and printing quality dramatically. The present device also allows flexibility of application by increasing or decreasing intensity as needed by the process without adversely impacting required space.

A suitable fiber optic cable will efficiently transmit UV light from the light source through the lens to the substrate. Acceptable materials for fiber optic cable of this invention include silica, fluorozirconate, fluoroaluminate, phosphate, and chalcogenide glasses, and low loss plastic optical fibers as well as crystalline materials such as sapphire. Regarding silica materials, a high OH concentration has been found to be suitable for UV transmission. Suitable materials for some fiber optic embodiments include Poly(methyl methacrylate) (PMMA), polystyrene and BK-7. Suitable lenses may include sapphire and BK-7. Specific materials suitable for certain embodiments include borosilicate and fused silica.

While the instant heads are contemplated to include aluminum, other materials such as polymers, wood, or metals could be used as well. Suitable synthetic resins may be used for the heads of this invention and a person of ordinary skill in the art will readily recognize that other synthetic resins may be suitable for a given embodiment of this invention. Other suitable synthetic resins may be found in the Handbook of Plastics, Elastomers, and Composites, Charles A. Harper, Editor in Chief, Third Edition, McGraw-Hill, New York, 1996, hereby incorporated by reference.

A suitable lens assembly for this invention is designed to collect and collimate the light leaving the light source to deliver maximum curing effect to the substrate. The first stage of the lens array or assembly may collect the light, which may leave the light source with a lambertian angular distribution. The second stage of the lens array or assembly then focuses the collected light onto the fiber bundle, with an incident angle less than the critical angle. The lens may be designed in such a way as to create a focused image of the light source on the fiber bundle, delivering uniformly distributed light onto the curing substrate. An alternative embodiment is to use a molded optic lens, which has a complex three-dimensional geometric shape. This lens would accomplish collection, collimation, and focusing with a single lens, instead of a lens assembly or plurality of lenses. Optics could also be used between the light-emitting head and the substrate to further improve printing performance.

Thus, the present invention provides UV light to cure ink deposited on a substrate remote to the LED or other device used to emit UV spectrum electromagnetic radiation. Being remotely configured allows for light to be delivered to desired locations without allocating space for the LEDs themselves. Additionally, heat can be removed remotely as well to reduce or eliminate undesirable effects of heat on ink jets, substrate, or ink being cured.

While UV-curable inks are commonly used in printing, some inks cure more efficiently when exposed to UV light having specific spectral compositions. Accordingly, differing spectra can be delivered onto substrate being printed. For example a spectrum having differing wavelength compositions could be emitted from each of the heads to enable more thorough curing for inks being used.

The larger LED chips contemplated for use in this invention generate desired light spectra over a larger area than previously possible. Accordingly, the optic fiber bundle is dimensioned and has a geometry sufficient for essentially all generated light to be transmitted by the optic fibers.

Because numerous modifications of this invention may be made without departing from the spirit thereof, the scope of the invention is not to be limited to the embodiments illustrated and described. Rather, the scope of the invention is to be determined by the appended claims and their equivalents.

What is claimed is:

1. A curing assembly, comprising:

a lens;

a fiber optic cable having a plurality of optic fibers receiving light which has passed through said lens at a proximal end of the plurality of optic fibers relative to the lens and transmitting the light that passed through the lens to a distal end of the plurality of optic fibers relative to the lens at a position remote from the lens; and a plurality of pinning heads located at the remote position where light emitted from the distal end of said optic fibers impinges a substrate in a geometric pattern, said pinning heads fixed in a position relative to said substrate, said optic fibers being substantially continuously and linearly positioned within said pinning heads.

2. The curing assembly of claim 1, further comprising a lens assembly, said lens assembly including said lens.

3. The curing assembly of claim 1, further comprising a light source generating light passing through said lens.

4. The curing assembly of claim 3, wherein said generated light includes ultraviolet light.

5. The curing assembly of claim 1, wherein said lens is a ball lens.

6. The curing assembly of claim 1, wherein said lens is a collimating lens.

7. The curing assembly of claim 1, wherein said lens is an aspherical lens.

8. The curing assembly of claim 1, further including a plate mounted to, and positioning, said pinning heads.

9. The curing assembly of claim 1, further including a focusing lens assembly and wherein said lens is a collimating lens, said focusing lens assembly focusing said light after said light has passed through said collimating lens.

10. The curing assembly of claim 1, wherein a plurality of said fiber optic cables are present, each of said fiber optic cables transmitting light to one of said pinning heads.

11. The curing assembly of claim 10, wherein a light source is present and wherein each of said fiber optic cables receives light generated by said light source.

12. The curing assembly of claim 11, wherein light generated by said light source includes light in the ultraviolet spectrum.

13. The curing assembly of claim 10, further comprising a plate, wherein each of said pinning heads are attached to, and positioned by, said plate.

* * * * *